US005400477A

United States Patent [19]

Marega et al.

[11] Patent Number: 5,400,477

[45] Date of Patent: Mar. 28, 1995

[54] CLOSING AND CLAMPING LEVER FOR A SKI BOOT

[75] Inventors: Antonello Marega; Giuseppe Goggia, both of Montebelluna, Italy

[73] Assignee: Calzaturificio Tecnica SpA, Treviso, Italy

[21] Appl. No.: 972,840

[22] Filed: Nov. 6, 1992

[30] Foreign Application Priority Data

Nov. 13, 1991 [IT] Italy ..... TV91 U 000036

[51] Int. Cl.[6] ..... A43C 11/14

[52] U.S. Cl. ..... 24/685 K

[58] Field of Search ..... 24/685 K, 695 K, 705 K, 24/715 K

[56] References Cited

U.S. PATENT DOCUMENTS 3,401,432 9/1968 Tresenreiter .

3,546,751 12/1970 Baso ..... 24/705 K 4,951,364 8/1990 Maraga ..... 24/685 K

FOREIGN PATENT DOCUMENTS 1813106 7/1969 Germany .

8002933 8/1980 Germany .

*Primary Examiner*—James R. Brittain

*Attorney, Agent, or Firm*—Griffin Butler Whisenhunt & Kurtossy

[57] ABSTRACT

The closing and clamping lever for a ski boot comprises a substantially perimetral structural casing (10a,12a,13a) which is provided on at least the sides of the body (10b,12b,13b) of its components, which is made of plastic. A couple of transverse portions (27,28) are also provided. The casing is for example made of metal or an engineering polymer. In this latter case it may be manufactured integrally with the body (10b,12b,13b) of the lever components.

9 Claims, 1 Drawing Sheet

CLOSING AND CLAMPING LEVER FOR A SKI BOOT

BACKGROUND OF THE INVENTION

The present invention relates to a closing and clamping lever for a ski boot. It is known that, with regard to the manufacture of the abovementioned levers, there has been a gradual transition from levers made entirely of metal to plastic levers. This transition has occurred at the same pace as developments in the design of the boots which, in accordance with the latest techniques, are manufactured in plastic. Completely metal levers for a long time were preferred on account of their intrinsic feature of particularly high mechanical strength useful for withstanding the extreme stress to which they are subjected when the boot is used.

The levers in question had the drawback, however, that their painted surfaces possessed poor scratch-resistance such that they rapidly assumed an appearance which was unacceptable from an aesthetic point of view. The abovementioned drawback affected in particular the body or central core of the lever components both because it is the part of the lever which is most exposed and subject to knocks and blows and because said body has a not insignificant length and any damage is immediately visible and results in an aesthetically displeasing effect of the entire boot.

There has thus been a gradual transition to plastic closing and clamping levers which have proved to be suitable for elimination of the abovementioned drawback. Plastic levers, however, while also offering advantages of an economic nature with regard to the industrial manufacturing process, still possessed drawbacks associated mainly with the fact that their mechanical strength is less than that of metal levers. The cross-sections of the plastic levers could not be reduced beyond certain limits. The said levers therefore proved to be generally bulky, which obviously conflicts with the general tendancy of designing the boot so as to have, overall, an aerodynamic and sleek look.

A closing and clamping lever for a ski boot, which is able to achieve the advantages of both metal and plastic levers while at the same time eliminating the disadvantages associated therewith, has now been devised and represents the subject of the present invention.

SUMMARY OF THE INVENTION

For this purpose the present invention relates to a closing and clamping lever for a ski boot which is characterised in that it comprises a substantially perimetral structural casing on at least the sides of a body which is preferably made of plastic.

With the lever according to the present invention, therefore, it is possible not only to achieve the abovementioned advantages of plastic levers, owing to the provision of the aforementioned structural reinforcing casing, but also to reduce the cross-section of its components and hence its overall dimensions. This proves to be particularly advantageous and hence favourable for the design of a ski boot with a sleek and aerodynamic look, resulting in a positive effect on the performance which can be achieved with the boot.

The characteristic features and advantages of the lever according to the present invention will become clear from the following detailed description of a non-limiting embodiment thereof with reference to the accompanying figures, in which:

DESCRIPTION OF THE PREFERRED EMBODIMENTS

Figure 5:
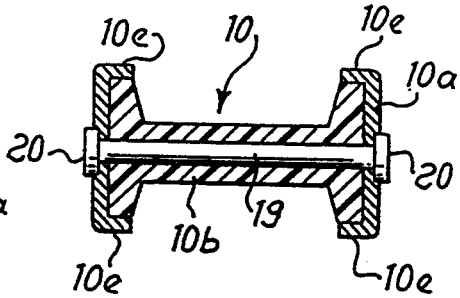
FIG. 5 is a view similar to FIG. 3, showing a possible alternative of the body of the lever components.
Figure 4:
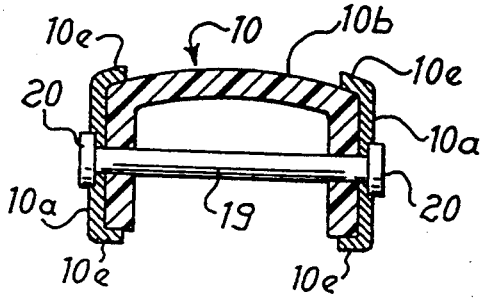
FIG. 4 is a view similar to FIG. 3, showing a possible alternative of the structural casing.
Figure 6:
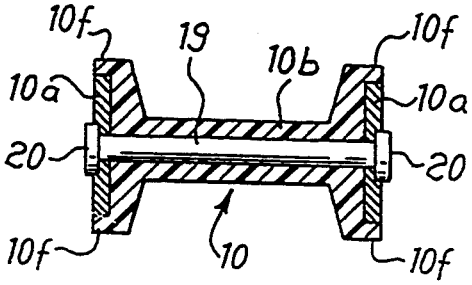
FIG. 6 is a view similar to FIG. 3, showing a further possible alternative of the body of the lever components.

The possible alternatives according to FIGS. 4 to 6 obviously fall within the scope of the innovative idea of the present invention described above, namely that of providing a substantially perimetral structural casing provided on at least the sides of the plastic body of the lever components.

DESCRIPTION OF THE PREFERRED EMBODIMENTS

Figure 1:
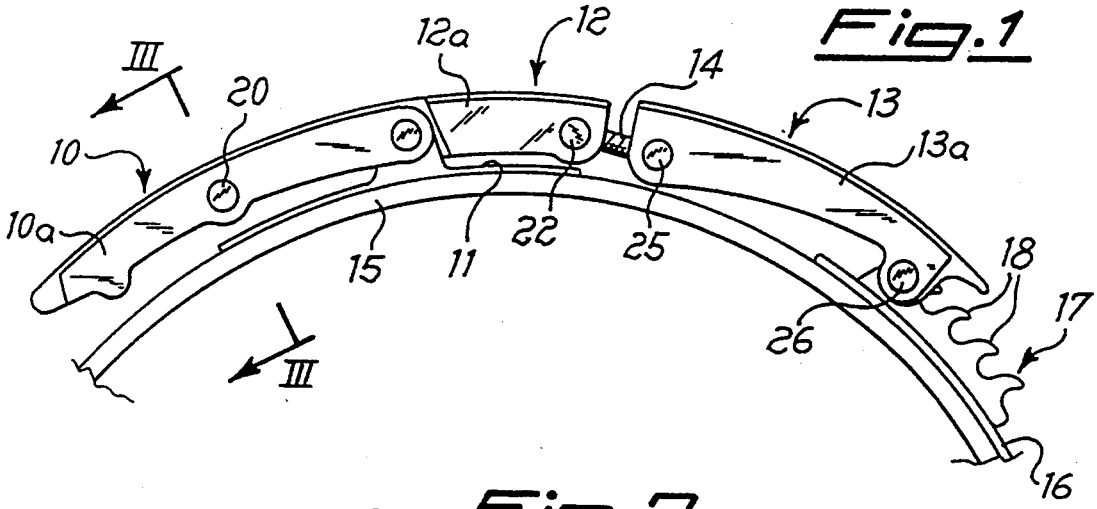
FIG. 1 is a schematic side view of the lever according to the invention shown in an operating or locked position.
Figure 2:
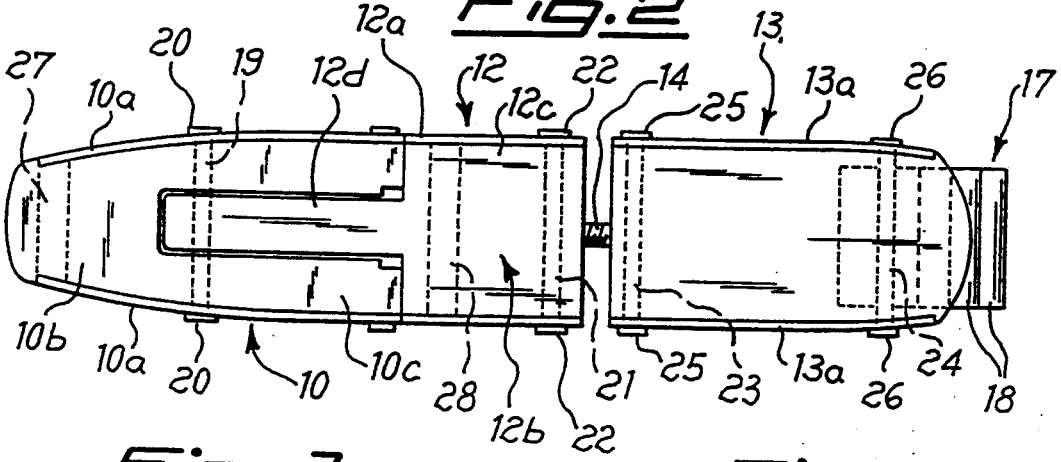
FIG. 2 is a schematic plan view of the lever.

With particular reference to FIGS. 1 and 2, the lever according to the present invention is of the type comprising an operating arm 10 which is pivotably hinged at the bottom with a plate 11 for fixing the lever to the boot, an articulating arm 12 and a fastening arm 13. The articulating arm 12 and the fastening arm 13 are connected together, in a known manner, by means of a screw 14 for adjusting the length of the lever.

The three arms 10, 12 and 13 referred to above are of the conventional type as regards functions, as can be seen in particular from FIG. 1, in which the lever is shown mounted on a boot where a flap 15 must be closed and clamped with respect to a part 16. The latter is provided with a conventional adjustable fastening member 17 with several positions defined by inclined ribbing 18.

Still with particular reference to FIGS. 1 and 2, it can be seen that the lever according to the present invention is provided, on both sides of the arms 10, 12 and 13, with a substantially perimetral structural casing which is indicated, for each of the said arms, by the reference numbers **10*a*, 12*a* and 13*a***, respectively.

Figure 3:
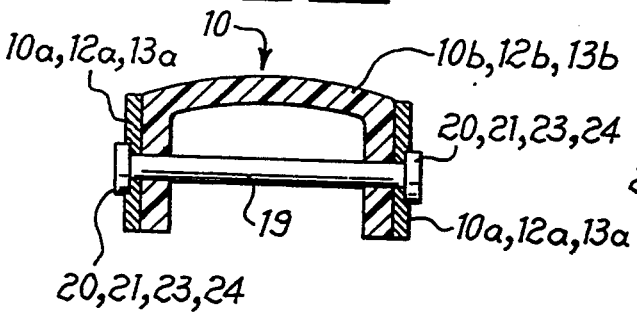
FIG. 3 is a view of the lever along the section III—III of FIG. 1.

As can be noted with reference, in addition to FIGS. 1 and 2, to FIG. 3, the structural casing **10*a*** is essentially composed of a flat wall with a profile identical to that of the sides of the body of the aforementioned arms such that it combines with their contour without projecting from the latter.

Fixing of the casing **10*a* to the body of the arm 10** is effected, in the example of embodiment considered, using the conventional pins with which these levers are provided.

With regard to the casing **10*a*, use is made of the hinging pin 19, the ends 20 of which are riveted so as to fix the aforementioned casing to the body of the arm 10. The casing or wall 10*a* is preferably metallic, thus forming a reinforcing structure which forms an integral part of the overall structure of the lever. This characteristic feature is clearly advantageous since the lever proves to have a particularly robust overall design, and the body of the arm 10 as well as the arms 12 and 13 may be differently shaped so as to satisfy both the requirements and the tastes of the user. As can be seen in particular from FIG. 3, the body 10***b* of the arm 10, which is made of plastic, has a cross-sectional shape essentially in the form of a U on the parallel sides of which the walls 10*a* are mounted externally.

The same comments made above in connection with the operating arm 10 may also made with respect to the articulating arm 12 and the fastening arm 13 since their overall configuration is entirely similar to that of the arm 10. Therefore, the cross-sectional view of the arm 10 (FIG. 3) may be regarded as being substantially valid for the other two arms, so that this figure contains the corresponding reference numbers for the parts of the other two arms, which have a similar configuration. Reference is made in particular to the walls 12*a*, 13*a* and to the bodies 12*b*, 13*b* of the arms 12 and 13, even though in reality the configuration of the body 12*b* of the arm 12 is slightly more complex, as a result of features, however, which, in addition to being known, do not form part of the innovative idea of the present invention; therefore this configuration is schematically shown as also being U-shaped.

In fact the body 12*b* of the aforementioned articulating arm 12 consists, in a conventional manner, of an enlarged portion or "head-piece" 12*c* connected on one side, by means of the screw 14, to the fastening arm 13, while on the opposite side it extends in the form of a lug 12*d* inserted between two branches 10*c* of the forked-shaped end of the operating arm 10 and connected thereto in a conventional manner not shown in detail.

As can be seen in particular from FIGS. 1 and 2, the articulating arm 12 is provided with the structural casing 12*a*, only over part of its body 12*b* and more specifically on the sides of its head-piece 12*c*. The casing 12*a*, as can be seen from FIG. 3, has a configuration similar to that of the casing 10*a*. It is fixed to the body 12*b* of the arm 12 by means of the pin 21 which serves for connection of the screw 14, the ends 22 of which are riveted so as to retain the aforementioned casing 12*a* on the head-piece 12*c* of the arm 12.

The casing 12*a*, by way of a non-limiting example, is also made of metal while the body 12*b* of the arm is made of plastic, thus enabling all of the abovementioned advantages for the arm 10 to be achieved.

The fastening arm 13 has a configuration similar to that of the other arms as regards the casing 13*a* which is for example metallic and its body 13*b* which is made of plastic. Therefore the same considerations outlined above in connection with the preceding two arms are also applicable here. The casing 13*a* is fixed to the body 13*b* by means of the pins 23,24 which serve, respectively, for mounting in a known manner the screw 14 and fastening the lever, the ends 25, 26 of which are riveted in order to retain the aforementioned casing 13*a*.

With reference now to FIGS. 4 to 6, a brief description is given of possible alternative embodiments of the structural casing and of the body of the components which form the lever according to the invention. In these figures, which show for the sake of illustrational clarity only the reference numbers of the arm 10, but must be regarded as being valid for the other arms as well, it can be seen that the casing 10*a* has a height slightly greater than that of the sides of the body 10*b*. Its ends 10*e* are folded towards the inside of the lever and cover the lower and upper edges of the sides of the body 10*e*. Preferably the external surface of the folded ends 10*b* is smoothed so as to eliminate any dangerous sharp edges. Obviously all the other abovementioned considerations are also applicable here.

From FIG. 5 it can be seen that the body 10*b* has a cross-sectional shape essentially in the form of a double T, on the end faces of which the structural casing 10*a* is mounted. The latter has the same constructional design as in FIG. 4. From FIG. 6 it can be seen that the body 10*b* has a configuration similar to that of FIG. 5, but its sides are higher than the casing 10*a*, the upper and lower edges of which are covered by the ends 10*f* of the body 10*b*.

Obviously the abovementioned considerations are also applicable to these embodiments. With particular reference now to FIG. 2 it can be seen that the casings 10*a* and 12*a* also comprise a transverse portion or element 27, 28 substantially in the region of the end of the arm 10 and on the head-piece 12*c* of the arm 12, which form an additional structural element for reinforcing the lever. Similar transverse portions, not shown, may also be provided in the region of the contour of the other arms.

The structural casing of the lever according to the invention, in addition to being made of metal as referred to above, may also be made of an engineering polymer. This offers the advantageous possibility of manufacturing the aforementioned casing integrally with the body of its components by means of a co-injection process.

The above description clearly demonstrates the advantages resulting from use of the lever according to the present invention, the principles of which may be summarised as follows:

a. Possibility of suitably shaping the body of the various components of the lever since they may be obtained by means of plastic moulding and hence may also be provided with shapes which it is impossible to achieve with metal components;

b. Possibility of reducing the cross-sections of the components since the latter, despite being made of plastic, are suitable for withstanding even considerable stresses owing to the provision of the aforementioned structural casing;

c. Design of a lever which is particularly wear-resistant.

It is obvious that conceptually and structurally equivalent variations and modifications of the lever are possible and may be envisaged without departing from the protective scope of the present invention.

It is claimed:

1. In a closing and clamping lever for a ski boot having an operating arm, an articulating arm and a fastening arm which cooperate to close a flap on a ski boot and which arms have a body portion made of plastic, the improvement comprising a structural casing composed of walls fixed onto outward sides of the body portion and the walls cover partially upper and lower edges of the outward sides of the body portion, which upper lower edges are transverse relative to the walls, said casing being made of metallic material or a polymer.

2. Closing and clamping lever according to claim 1, wherein said walls are made of a metallic material.

3. Closing and clamping lever according to claim 1, wherein the body portion has a cross-sectional shape essentially in the form of a U.

4. Closing and clamping lever according to claim 1, wherein said structural casing is made of a polymer.

5. Closing and clamping lever according to claim 1, wherein the structural casing has at least one transverse portion.

6. In a closing and clamping lever for a ski boot having an operating arm, an articulating arm and a fastening arm which cooperate to close a flap on a ski boot and which arms have a body portion made of plastic, the improvement comprising a structural casing composed of walls fixed onto outward sides of the body portion and upper and lower edges of said walls are transverse relative to the walls and are covered by corresponding edges of the outward sides of the body portion, said casing being made of metallic material or a polymer.

7. Closing and clamping lever according to claim 1, wherein the body portion has a cross-sectional shape essentially in the form of a double T.

8. Closing and clamping lever according to claim 6, wherein said walls are made of a metallic material.

9. Closing and clamping lever according to claim 6, wherein said structural casing is made of a polymer.

* * * * *